US012806733B2

(12) United States Patent
Wiswell et al.

(10) Patent No.: US 12,806,733 B2
(45) Date of Patent: Nov. 24, 2026

(54) ACOUSTIC WINDOW IN PAD BACKING LAYER FOR CHEMICAL MECHANICAL POLISHING

(71) Applicant: Applied Materials, Inc., Santa Clara, CA (US)

(72) Inventors: Nicholas A. Wiswell, Sunnyvale, CA (US); Benjamin Cherian, San Jose, CA (US); Thomas H. Osterheld, Mountain View, CA (US); Jason Garcheung Fung, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 148 days.

(21) Appl. No.: 17/857,999

(22) Filed: Jul. 5, 2022

(65) Prior Publication Data

US 2023/0009737 A1 Jan. 12, 2023

Related U.S. Application Data

(60) Provisional application No. 63/218,897, filed on Jul. 6, 2021.

(51) Int. Cl.

| | |
|---|---|
| ***B24B 37/20*** | (2012.01) |
| ***B24B 37/013*** | (2012.01) |
| ***B24B 37/22*** | (2012.01) |
| ***B24B 37/24*** | (2012.01) |
| ***B24B 49/00*** | (2012.01) |
| ***B24B 49/10*** | (2006.01) |

(52) U.S. Cl.

CPC ..... *B24B 37/205* (2013.01); *B24B 37/013* (2013.01); *B24B 37/22* (2013.01); *B24B 37/24* (2013.01); *B24B 49/003* (2013.01); *B24B 49/10* (2013.01)

(58) Field of Classification Search

CPC ..... B24B 37/205; B24B 37/20; B24B 37/22; B24B 37/24; B24B 49/003; B24B 49/00

See application file for complete search history.

(56) References Cited

U.S. PATENT DOCUMENTS 3,149,946 A * 9/1964 Elmer ..... C03C 3/061 216/97
5,222,329 A 6/1993 Yu
5,240,552 A 8/1993 Yu et al.

(Continued)

FOREIGN PATENT DOCUMENTS

CN 102245350 11/2011
CN 105345652 2/2016

(Continued)

OTHER PUBLICATIONS

International Search Report and Written Opinion in International Appln. No. PCT/US2022/073435, mailed on Oct. 14, 2022, 12 pages.

(Continued)

*Primary Examiner* — Monica S Carter
*Assistant Examiner* — Kent N Shum
(74) *Attorney, Agent, or Firm* — Fish & Richardson P.C.

(57) ABSTRACT

A polishing pad includes a polishing layer, a backing layer, and an acoustic window of solid material having an acoustic impedance less than that of the backing layer and extending through the backing layer to contact the bottom surface of the polishing layer.

14 Claims, 5 Drawing Sheets

(56) References Cited

U.S. PATENT DOCUMENTS

| | | | | |
|---|---|---|---|---|
| 5,399,234 | A | 3/1995 | Yu et al. | |
| 6,099,954 | A * | 8/2000 | Urbanavage | B24D 3/32 428/314.2 |
| 6,159,073 | A | 12/2000 | Wiswesser et al. | |
| 6,257,953 | B1 | 7/2001 | Gitis et al. | |
| 6,296,548 | B1 | 10/2001 | Wiswesser et al. | |
| 6,383,058 | B1 | 5/2002 | Birang et al. | |
| 6,454,630 | B1 * | 9/2002 | Tolles | B24B 49/12 451/526 |
| 6,488,569 | B1 | 12/2002 | Wang et al. | |
| 6,494,766 | B1 | 12/2002 | Wiswesser et al. | |
| 6,716,085 | B2 * | 4/2004 | Wiswesser | B24B 37/205 451/526 |
| 6,746,319 | B2 | 6/2004 | Tada et al. | |
| 6,780,095 | B1 * | 8/2004 | Moore | B24B 37/26 451/527 |
| 6,860,793 | B2 | 3/2005 | Budinger et al. | |
| 6,884,156 | B2 | 4/2005 | Prasad et al. | |
| 6,910,942 | B1 | 6/2005 | Dornfeld et al. | |
| 6,997,777 | B2 | 2/2006 | Newell | |
| 7,029,747 | B2 | 4/2006 | Huh et al. | |
| 7,052,364 | B2 | 5/2006 | Zhang et al. | |
| 7,273,407 | B2 | 9/2007 | Saikin | |
| 7,537,511 | B2 | 5/2009 | Kistler | |
| 7,727,049 | B2 | 6/2010 | Benvegnu et al. | |
| 7,892,070 | B2 | 2/2011 | Bottema et al. | |
| 8,485,862 | B2 | 7/2013 | Swedek et al. | |
| 9,475,168 | B2 * | 10/2016 | Qian | B24B 37/205 |
| 10,478,937 | B2 | 11/2019 | Tang et al. | |
| 10,493,691 | B2 | 12/2019 | Krishnan | |
| 2002/0173223 | A1 | 11/2002 | Gitis et al. | |
| 2003/0049993 | A1 | 3/2003 | Fujii | |
| 2003/0087586 | A1 | 5/2003 | Kaushal et al. | |
| 2004/0106357 | A1 | 6/2004 | Birang et al. | |
| 2004/0253910 | A1 | 12/2004 | Lim et al. | |
| 2005/0060943 | A1 | 3/2005 | Turner et al. | |
| 2005/0150599 | A1 | 7/2005 | Dalrymple et al. | |
| 2006/0000807 | A1 | 1/2006 | Golzarian | |
| 2007/0042681 | A1 * | 2/2007 | Benvegnu | H10P 74/238 451/6 |
| 2007/0042682 | A1 * | 2/2007 | Saikin | B24B 37/205 451/6 |
| 2007/0042693 | A1 | 2/2007 | Saikin | |
| 2007/0218806 | A1 | 9/2007 | Kistler | |
| 2007/0235133 | A1 | 10/2007 | Benassi | |
| 2007/0243794 | A1 | 10/2007 | Mundt | |
| 2008/0227367 | A1 | 9/2008 | Birang et al. | |
| 2009/0053976 | A1 | 2/2009 | Roy et al. | |
| 2010/0018311 | A1 | 1/2010 | Batzinger et al. | |
| 2010/0184357 | A1 | 7/2010 | Qian et al. | |
| 2011/0016975 | A1 | 1/2011 | Glaesemann et al. | |
| 2011/0313558 | A1 * | 12/2011 | Lehman | B24B 49/04 700/108 |
| 2013/0012108 | A1 | 1/2013 | Li et al. | |
| 2013/0044004 | A1 | 2/2013 | Hwang et al. | |
| 2014/0027407 | A1 | 1/2014 | Deshpande et al. | |
| 2014/0030956 | A1 | 1/2014 | Zhang et al. | |
| 2014/0038501 | A1 | 2/2014 | Birang et al. | |
| 2014/0329439 | A1 | 11/2014 | Chew et al. | |
| 2015/0174826 | A1 | 6/2015 | Murugesh et al. | |
| 2015/0273649 | A1 | 10/2015 | Kosuge et al. | |
| 2016/0013085 | A1 | 1/2016 | Chew et al. | |
| 2016/0256978 | A1 * | 9/2016 | Tang | B24B 37/013 |
| 2016/0263721 | A1 | 9/2016 | So et al. | |
| 2017/0259394 | A1 | 9/2017 | Takahashi et al. | |
| 2018/0056477 | A1 | 3/2018 | Butterfield et al. | |
| 2018/0071889 | A1 | 3/2018 | Huang et al. | |
| 2018/0085888 | A1 | 3/2018 | Hendron et al. | |
| 2019/0047112 | A1 | 2/2019 | Fu et al. | |
| 2019/0143474 | A1 | 5/2019 | Wang et al. | |
| 2019/0283204 | A1 | 9/2019 | Swedek et al. | |
| 2020/0135517 | A1 | 4/2020 | Fung et al. | |
| 2020/0238472 | A1 | 7/2020 | Ahn et al. | |
| 2022/0281057 | A1 | 9/2022 | Wiswell et al. | |
| 2022/0281058 | A1 | 9/2022 | Wiswell et al. | |
| 2023/0009048 | A1 | 1/2023 | Wiswell et al. | |
| 2023/0009519 | A1 | 1/2023 | Wiswell et al. | |
| 2023/0011626 | A1 | 1/2023 | Wiswell et al. | |

FOREIGN PATENT DOCUMENTS

| | | | | |
|---|---|---|---|---|
| CN | 207289796 | U | 5/2018 | |
| CN | 111347341 | | 6/2020 | |
| GB | 466212 | A * | 5/1937 | H04N 5/66 |
| JP | 2003-236749 | | 8/2003 | |
| JP | 2007-044814 | A | 2/2007 | |
| JP | 2008105117 | A | 5/2008 | |
| JP | 2009-531192 | A | 9/2009 | |
| JP | 2010-023134 | | 2/2010 | |
| JP | 5533666 | | 6/2014 | |
| JP | 2015517926 | A | 6/2015 | |
| JP | 2020-074408 | A | 5/2020 | |
| KR | 20000013554 | U | 7/2000 | |
| KR | 10-2004-0083608 | | 10/2004 | |
| KR | 20040083608 | | 10/2004 | |
| KR | 10-2010-0071006 | A | 6/2010 | |
| KR | 10-2018-0035698 | A | 4/2018 | |
| KR | 10-2018-0118896 | | 11/2018 | |
| TW | 201529652 | | 8/2015 | |
| TW | 201632302 | | 9/2016 | |
| TW | 201720582 | | 6/2017 | |
| WO | WO 2002/038336 | | 5/2002 | |
| WO | WO 2006/057714 | | 6/2006 | |

OTHER PUBLICATIONS

International Search Report and Written Opinion in International Appln. No. PCT/US2022/016850, dated May 19, 2022, 11 pages.
International Search Report and Written Opinion in International Appln. No. PCT/US2022/077724, mailed on Feb. 27, 2023, 11 pages.
Office Action in Taiwanese Appln. No. 111125134, dated May 22, 2023, 20 pages (with English Summary and Search Report).
U.S. Appl. No. 17/855,520, Wiswell et al., Jun. 30, 2022.
U.S. Appl. No. 17/858,000, Wiswell et al., Jul. 5, 2022.
U.S. Appl. No. 17/858,006, Wiswell et al., Jul. 5, 2022.
U.S. Appl. No. 18/365,482, filed Aug. 4, 2023, Cherian et al.
Aleman et al., Definitions of Terms Relating to the Structure and Processing of Sols, Gels, Networks, and Inorganic-Organic Hybrid Materials (IUPAC Recommendations 2007), Pure and Applied Chemistry, Jan. 2007, 79(10):1801-1829.
Office Action in Japanese Appln. No. 2024-500055, mailed on Feb. 12, 2025, 9 pages (with English translation).
Office Action in Korean Appln. No. 10-2024-7003869, mailed on Jan. 24, 2025, 30 pages (with English translation).
Office Action in Korean Appln. No. 10-2024-7003869, mailed on Jul. 31, 2025, 32 pages (with English translation).
Extended European Search Report in Appln. No. 22838551.4, mailed on Apr. 23, 2025, 12 pages.
Office Action in Chinese Appln. No. 202280047772.3, mailed on Jan. 8, 2026, 18 pages (with English translated summary and search report).

* cited by examiner

ACOUSTIC WINDOW IN PAD BACKING LAYER FOR CHEMICAL MECHANICAL POLISHING

CROSS-REFERENCE TO RELATED APPLICATIONS

This application claims the benefit of priority to U.S. Application No. 63/218,897, filed on Jul. 6, 2021, the contents of which are hereby incorporated by reference.

TECHNICAL FIELD

This disclosure relates to in-situ monitoring of chemical mechanical polishing, and more particularly to in-situ acoustic monitoring during polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized time period, e.g., by polishing for a predetermined time period, to leave a portion of the filler layer over the nonplanar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, such as when a polishing endpoint has been reached, e.g., whether a substrate layer has been planarized to a desired flatness or thickness, when a desired amount of material has been removed, or when an underlying layer has been exposed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, the polishing endpoint usually cannot be determined merely as a function of polishing time.

In some systems, the substrate is monitored in-situ during polishing, e.g., by monitoring the torque required by a motor to rotate the platen or carrier head. Acoustic monitoring of polishing has also been proposed.

SUMMARY

In one aspect, a polishing pad includes a polishing layer, a backing layer, and an acoustic window of solid material having an acoustic impedance less than that of the backing layer and extending through the backing layer to contact the bottom surface of the polishing layer.

In another aspect, a polishing pad includes a polishing layer, a backing layer, and an acoustic window extending through the backing layer and the polishing layer. An upper surface of the acoustic window is coplanar with a polishing surface of the polishing layer.

In another aspect, a chemical mechanical polishing apparatus includes a platen, a polishing pad of either of the two aspects above supported on the platen, a carrier head to hold a substrate against the polishing pad, a motor to generate relative motion between the platen and the carrier head so as to polish an overlying layer of the substrate, an in-situ acoustic monitoring system including an acoustic sensor coupled to the acoustic window to receive acoustic signals from the substrate, and a controller configured to detect a polishing transition point based on received acoustic signals from the in-situ acoustic monitoring system.

In another aspect, a chemical mechanical polishing apparatus includes a platen, a polishing pad supported on the platen, a carrier head to hold a surface of a substrate against a polishing surface of the polishing pad, and a motor to generate relative motion between the platen and the carrier head so as to polish an overlying layer of the substrate. The polishing pad includes a polishing layer including a solid matrix material with liquid-filled pores, and a backing layer. An in-situ acoustic monitoring system includes an acoustic sensor coupled to the backing layer to receive acoustic signals from the substrate, and a controller is configured to detect a polishing transition point based on received acoustic signals from the in-situ acoustic monitoring system.

In another aspect, a method of fabricating a polishing pad includes successively depositing a first plurality of layers with a 3D printer to form a backing layer of the polishing pad, and successively depositing a second plurality of layers with the 3D printer to form a polishing layer of the polishing pad on the backing layer. Each layer of the first plurality of layers includes a backing material portion and an acoustic window portion having a lower acoustic impedance than the backing material portion. The backing material portion and the acoustic window portion are deposited by ejecting a plurality of precursor materials from one or more nozzles and solidifying the plurality of precursor materials to form a solidified backing material and a solidified acoustic window. Ejecting the plurality of precursor materials from the one or more nozzles forms an interface with intermingled polymer that directly bonds the solidified acoustic window and the solidified backing material.

In another aspect, method for manufacturing a polishing pad includes depositing a backing layer of a first material, curing the backing layer, depositing a polishing layer of a second material atop the backing layer, curing the polishing layer, removing a portion of the backing layer creating an aperture, and inserting an acoustic window of a third material into the aperture.

One or more of the following possible advantages may be realized. Signal strength of an acoustic sensor can be increased. Exposure of an underlying layer can be detected more reliably. Polishing can be halted more reliably, and wafer-to-wafer uniformity can be improved. The stability of the signal intensity can be improved, both over short time scales, e.g, —due to greater control over the mechanical properties of the material above the sensor, and over longer time scales, e.g., due to greater control over transmission temperature dependence.

The acoustic window in contact with the transducer can be sized to match the transducer to increase sensitivity. Alternatively, the acoustic window can have a reduced diameter to reduce the effective "spot size" of the transducer and data collected therefrom.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference symbols in the various drawings indicate like elements.

DETAILED DESCRIPTION

In some semiconductor chip fabrication processes an overlying layer, e.g., metal, silicon oxide or polysilicon, is polished until an underlying layer, e.g., a dielectric, such as silicon oxide, silicon nitride or a high-K dielectric, is exposed. For some applications, when the underlying layer is exposed, the acoustic emissions from the substrate will change. The polishing endpoint can be determined by detecting this change in acoustic signal. However, existing monitoring techniques may not satisfy increasing demands of semiconductor device manufacturers.

The acoustic emissions to be monitored can be caused by energy released when the substrate material undergoes deformation, and the resulting acoustic spectrum is related to the material properties of the substrate. Without being limited to any particular theory, possible sources of this energy, also termed "stress energy", and its characteristic frequencies include breakage of chemical bonds, characteristic phonon frequencies, slip-stick mechanisms, etc. It may be noted that this stress energy acoustic effect is not the same as noise generated by vibrations induced by friction of the substrate against the polishing pad (which is also sometimes referred to as an acoustic signal), or of noise generated by cracking, chipping, breakage or similar generation of defects on the substrate. The stress energy can be distinguished from other acoustic signals, e.g., from friction of the substrate against the polishing pad or of noise generated by generation of defects on the substrate, through appropriate filtering. For example, the signal from the acoustic sensor can be compared to a signal measured from a test substrate that is known to represent stress energy.

However, a potential problem with acoustic monitoring is transmission of the acoustic signal to the sensor. Acoustic emissions caused by stress energy can be subject to significant noise, so a strong signal is needed. However, conventional polishing pads, e.g., with porous polishing and backing layers, tend to dampen the signal.

Thus, it would be advantageous to utilize a polishing pad with low attenuation of the acoustic signal to decrease noise in the acoustic signal. A polishing pad including an acoustic window having beneficial acoustic properties such as low acoustic attenuation facilitates acoustic signal transmission to the acoustic sensor, reducing signal noise. Additionally, the acoustic window having compressive properties similar to the surrounding polishing pad layer, e.g., the polishing layer, or the backing layer, reduce acoustic signal reflection due to adjacent boundaries and maintains polishing characteristics of the polishing pad. Any of these advantages could be used independent of the other advantages.

Figure 1:
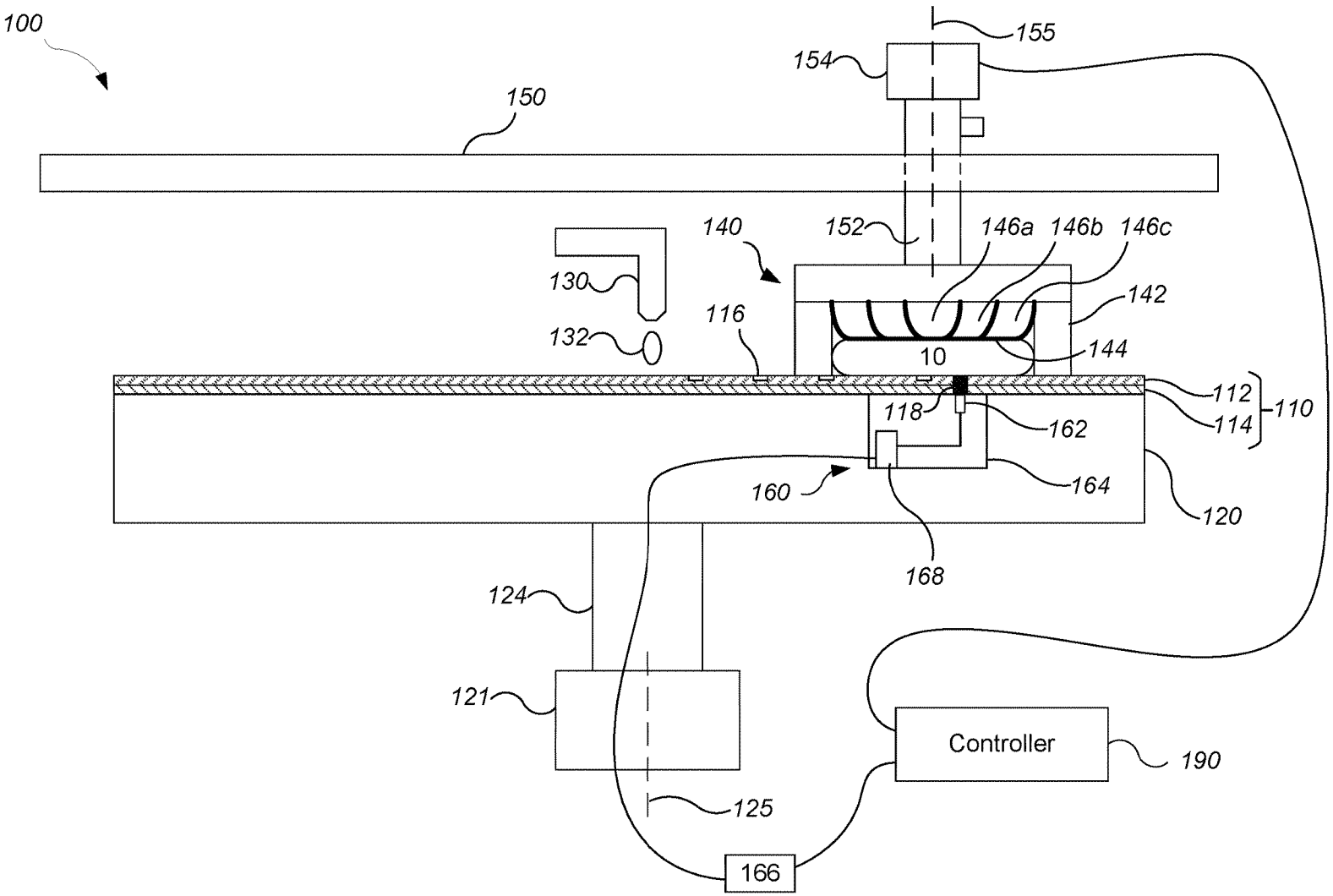
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The polishing pad 110 can be a two-layer polishing pad with an outer polishing layer 112 and a softer backing layer 114. The platen is operable to rotate about an axis 125. For example, a motor 121, e.g., a DC induction motor, can turn a drive shaft 124 to rotate the platen 120.

The polishing apparatus 100 can include a port 130 to dispense polishing liquid 132, such as abrasive slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. Each carrier head 140 can have independent control of the polishing parameters, for example pressure, associated with each respective substrate.

The carrier head 140 can include a retaining ring 142 to retain the substrate 10 below a flexible membrane 144. The carrier head 140 also includes one or more independently controllable pressurizable chambers defined by the membrane, e.g., three chambers 146*a*-146*c*, which can apply independently controllable pressurizes to associated zones on the flexible membrane 144 and thus on the substrate 10 (see FIG. 1). Although only three chambers are illustrated in FIG. 1 for ease of illustration, there could be one or two chambers, or four or more chambers, e.g., five chambers.

The carrier head 140 is suspended from a support structure 150, e.g., a carousel or track, and is connected by a drive shaft 152 to a carrier head rotation motor 154, e.g., a DC induction motor, so that the carrier head can rotate about an axis 155. Optionally each carrier head 140 can oscillate laterally, e.g., on sliders on the carousel 150, or by rotational oscillation of the carousel itself, or by sliding along the track. In typical operation, the platen is rotated about its central axis 125, and each carrier head is rotated about its central axis 155 and translated laterally across the top surface of the polishing pad.

A controller 190, such as a programmable computer, is connected to the motors 121, 154 to control the rotation rate of the platen 120 and carrier head 140. For example, each motor can include an encoder that measures the rotation rate of the associated drive shaft. A feedback control circuit, which could be in the motor itself, part of the controller, or a separate circuit, receives the measured rotation rate from the encoder and adjusts the current supplied to the motor to ensure that the rotation rate of the drive shaft matches at a rotation rate received from the controller.

The polishing apparatus 100 includes at least one in-situ acoustic monitoring system 160. The in-situ acoustic monitoring system 160 includes one or more acoustic signal sensors 162 and, in some implementations, one or more acoustic signal generators 163 that are each configured to actively transmit acoustic energy toward a side of the substrate 10 closer to the polishing pad 110. Each acoustic signal sensor or acoustic signal generator can be installed at one or more locations on the upper platen 120. In particular, the in-situ acoustic monitoring system can be configured to detect acoustic emissions caused by stress energy when the material of the substrate 10 undergoes deformation and, in implementations where acoustic signal generators 163 are included, to detect the reflection of actively generated acoustic signals from the surface of the substrate 10.

A position sensor, e.g., an optical interrupter connected to the rim of the platen or a rotary encoder, can be used to sense the angular position of the platen 120. This permits only portions of the signal measured when the sensor 162 is in proximity to the substrate, e.g., when the sensor 162 is below the carrier head or substrate, to be used in endpoint detection.

In the implementation shown in FIG. 1, the acoustic sensor 162 is positioned in a recess 164 in the platen 120 and is positioned to receive acoustic signals through an acoustic window 118. The acoustic sensor 162 can be connected by circuitry 168 to a power supply and/or other signal processing electronics 166 through a rotary coupling, e.g., a mercury slip ring. The signal processing electronics 166 can be connected in turn to the controller 190, which can be additionally configured to control the magnitude or frequency of the acoustic energy transmitted by the generator 163, e.g., by variably increasing or decreasing the current supply to the generator 163.

The in-situ acoustic monitoring system 160 can be a passive acoustic monitoring system. The passive acoustic signals monitored by the acoustic sensor 162 can be in 50 kHz to 1 MHz range, e.g., 200 to 400 kHz, or 200 Khz to 1 MHz. For example, for monitoring of polishing of inter-layer dielectric (ILD) in a shallow trench isolation (STI), a frequency range of 225 kHz to 350 kHz can be monitored. As another example, passive mode frequencies of interest range from 500 kHz to 900 kHz.

Referring to FIGS. 2A-2E, the polishing pad 100 includes a polishing layer 112 and a backing layer (sometimes referred to as a subpad) 114. The backing layer 114 is more compressible than the polishing layer 112.

In some implementations, a plurality of slurry-transport grooves 116 are formed in the polishing surface 112*a* of the polishing layer 112 of the polishing pad 110. The grooves 116 can extend partially but not entirely through the thickness of the polishing layer 112. Alternatively, the grooves 116 can extend entirely through the polishing layer 112. For example, the polishing layer 112 can be formed as a plurality of discrete segments that sit on the backing layer 114. In some implementations, the discrete segments of the polishing layer 112 extend into recesses in the backing layer 114.

In some implementations, grooving is omitted from the polishing surface 112*a* in a region 119 that is aligned with the acoustic sensor 162. The region 119 lacking grooves can be wider than the pitch between the grooves in the remaining region of the polishing layer. At least one groove can be interrupted, e.g., at least one groove in an otherwise rectangular array of grooves does not extend entirely across the polishing surface, or at least one groove in an otherwise concentric circular array of grooves does not extend entirely around the central axis. However, for any of the implementations discussed below it is possible to not omit the grooving from the region above the acoustic sensor 162.

In any of the implementations of FIGS. 2A-2E, the polishing layer 112 can be composed of a solid polymer matrix material 200 with liquid-filled pores 202. The matrix material 200 can be a polyurethane or mixture of polyurethanes, and the pores 202 can filled with water and/or a gel, e.g., a polymer gel. However, in some implementations the pores 202 in the polishing layer 112 are air-filled, e.g., provided by hollow microspheres. In some implementations, the pores 202 in the region 119 aligned with the acoustic sensor 162 are liquid-filled, but the pores 202 in other portions of the polishing layer 112 are air-filled.

In some implementations, the matrix material 200 of the polishing layer 112 and the gel in the pores 202 include different components, e.g., different polymers, that provide the different phases, i.e., liquid versus solid. However, in some implementations the matrix material 200 and the gel in the pores 202 are formed using the same two monomer or polymer components, but in different weight percentage contributions so as to provide the different phases. For example, assuming that a first monomer component polymerizes and solidifies more quickly than a second monomer component, the matrix material can include a higher percentage of the first component than the gel. Alternatively or in addition, multiple polymer components, e.g., with different hardnesses, can be present in the polishing layer 112 to achieve desired material properties and polishing characteristics. This combination of polymers within a layer can provided by a randomized blend or structured layout.

In addition, in any of the implementations of FIGS. 2A-2E, the backing layer 114 can be composed of a solid polymer matrix material 204, e.g., substantially without pores, e.g., porosity less than 1%, e.g., less than 0.5%. The matrix material of the backing layer 114 can be softer than the matrix material polishing layer 112. The matrix material of the polishing layer 112 and the matrix material of the backing layer 114 can be formed from the same monomer or polymer components, but in different weight percentage contributions. For example, assuming after curing that a first monomer component polymerizes more quickly or forms a harder polymer matrix than a second monomer component, the polishing layer 112 can include a higher percentage of the first component than the backing layer 114.

Figure 2A:
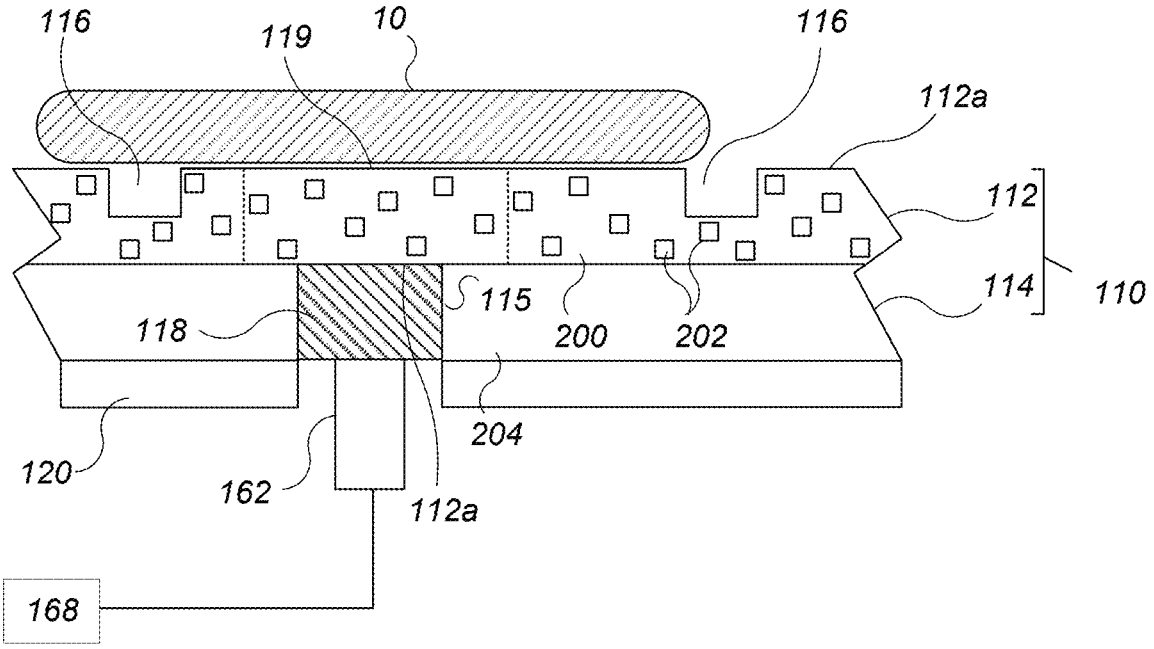
FIG. 2A illustrates a schematic cross-sectional view of a polishing pad having an acoustic window in contact with an acoustic sensor.

FIG. 2A shows a polishing layer 112 having a solid matrix material 200 and a plurality of pores 202. The region 119 above the acoustic window 118 includes pores 202 but lacks grooves 116. For example, the pores in the region 119 above the acoustic window 118 can have the same porosity, e.g., density and size of pores, as the remainder of the polishing layer 112. Conventional polishing pads typically include pores in the polishing layer, e.g., hollow polymer microspheres. Without being limited to any particular theory, in contrast to hollow pores which significantly increase acoustic attenuation, the liquid-filled pores are acoustically transmissive and thus do not increase acoustic attenuation such that a special window region is needed for the polishing layer 112.

The portion of the backing layer 114 directly above the acoustic sensor 162 can include an acoustic window 118.

The acoustic window 118 has a lower acoustic attenuation coefficient than the surrounding backing layer 114. The acoustic impedance of a material is a measure of the opposition that a material presents to the acoustic flow resulting from an acoustic pressure applied to the material. The acoustic attenuation coefficient quantifies how transmitted acoustic amplitude decreases as a function of frequency for a specific material.

The material of the acoustic window 118 has a sufficiently low acoustic attenuation coefficient, e.g., to provide a signal satisfactory for acoustic monitoring. The window can have an acoustic attenuation coefficient lower than 2 (e.g., lower than 1, lower than 0.5). to provide a signal satisfactory for acoustic monitoring. In general, the acoustic attenuation coefficient should be as low as possible (i.e., no absorption). The acoustic impedance of the window 118 can be between 1 and 4 MRayl. For example, the acoustic impedance of the window 118 can be reasonably close to water, e.g., about 1.4 MRayl.

Figure 2B:
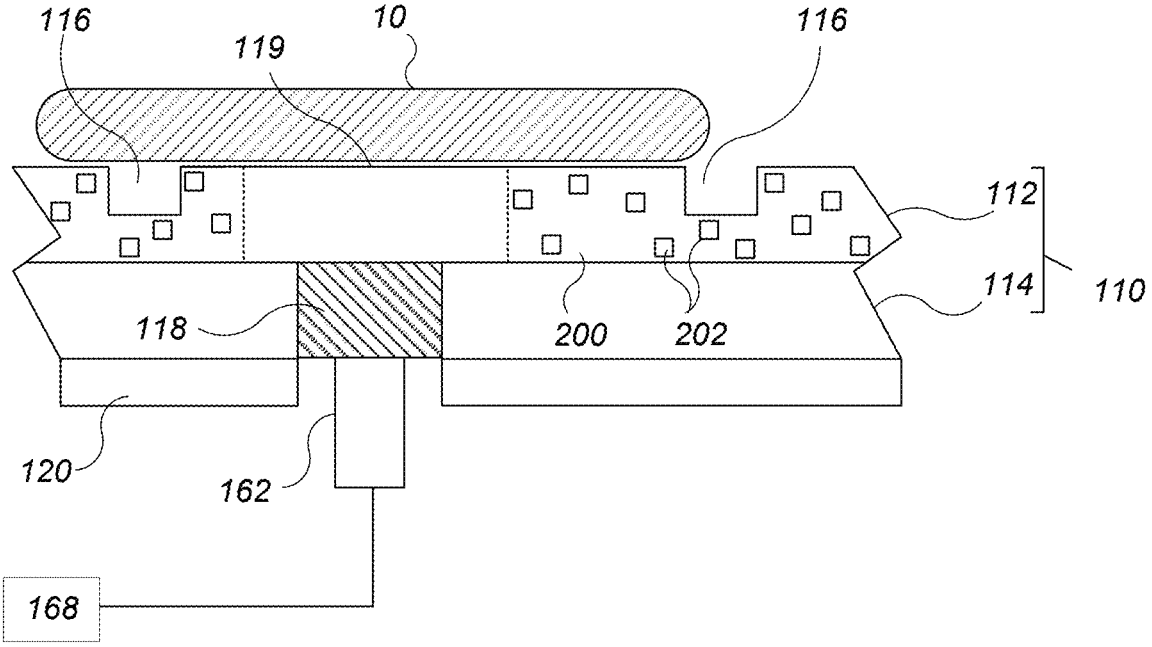
FIG. 2B illustrates a schematic cross-sectional view of another implementation of a polishing pad having an acoustic window in contact with an acoustic sensor.

In addition or as an alternative to a low attenuation coefficient, in implementations in which a window 118 sits between a portion 119 of the polishing layer 112 and the sensor 162, e.g., as shown in FIGS. 2A and 2B, the acoustic refractive index of the window 118 can be selected to provide index matching. The acoustic refractive index sets the speed of sound within a material. In particular, for the frequencies being measured, acoustic refractive index of the window 118 can be between (inclusive of the endpoints) the acoustic refractive index of the portion 119 of the polishing layer 112 and the material that contacts the bottom of the window, e.g., the top plate of the sensor 162 or an index matching gel. In particular, the acoustic refractive index of the window 118 can be equal to the acoustic refractive index of the portion 119 of the polishing layer 112. Alternatively, the acoustic refractive index of the window 118 can be between, but not equal to, the acoustic refractive index of the portion 119 of the polishing layer 112 and the material that contacts the bottom of the window. Index matching reduces reflections of acoustic energy at interfaces and thus can improve transmission of acoustic energy to the sensor 162.

In the implementations of FIGS. 2A-2D, the acoustic window 118 is formed of a different material than the backing layer 114. This permits the backing layer 114 to be composed of a wider range of materials to meet the needs of the CMP operation. The acoustic window 118 can be composed of a non-porous material, e.g., a solid body. For example, the acoustic material can be a polymer, e.g., a polyurethane. In some implementations, the acoustic window 118 and the backing layer 114 are formed using the same two monomer or polymer components, but in different weight percentage contributions. The percentage for the backing layer 118 can be selected so as to provide the desired compressibility, whereas the percentage for the window 114 can be selected so as to provide the desired acoustic transmission. In some implementations, the acoustic window 118 is a gel. In some implementations, the acoustic window 118 is a gel material.

Figure 2C:
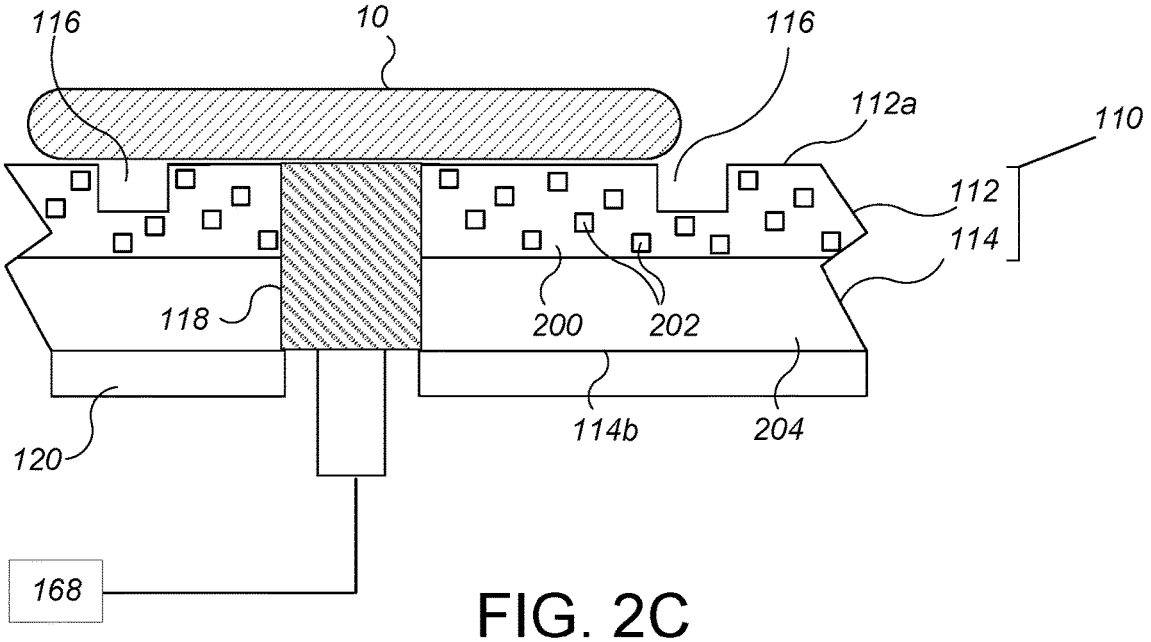
FIG. 2C illustrates a schematic cross-sectional view of an implementation of a polishing pad having an acoustic window extending through the polishing and backing layers of the polishing pad.
Figure 2D:
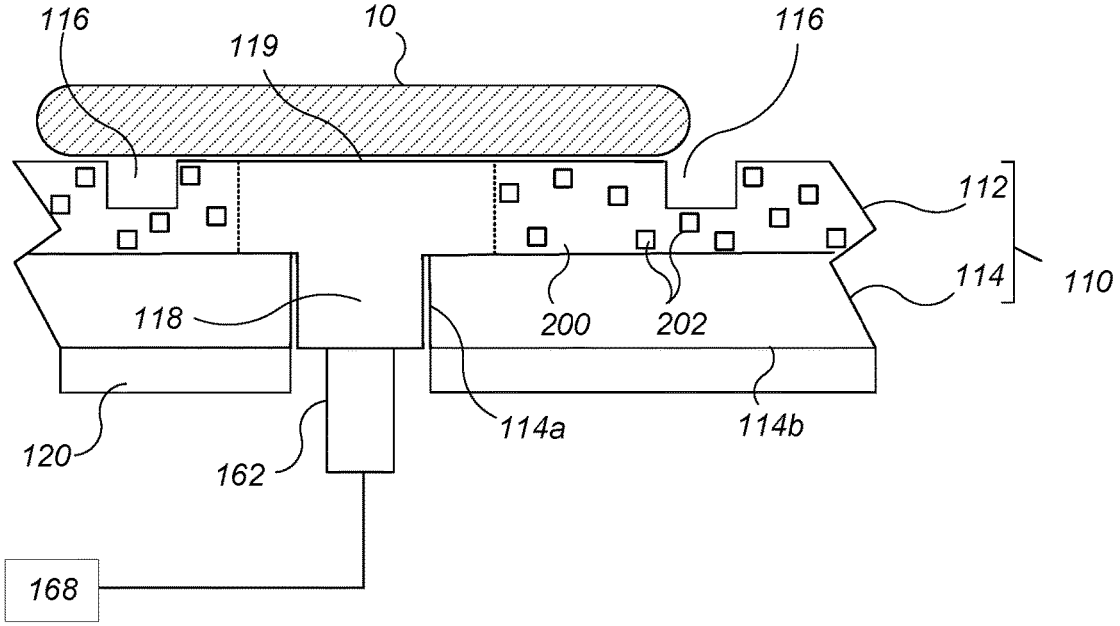
FIG. 2D illustrates a schematic cross-sectional view of another implementation of a polishing pad having an acoustic window extending through the polishing and backing layers of the polishing pad.
Figure 2E:
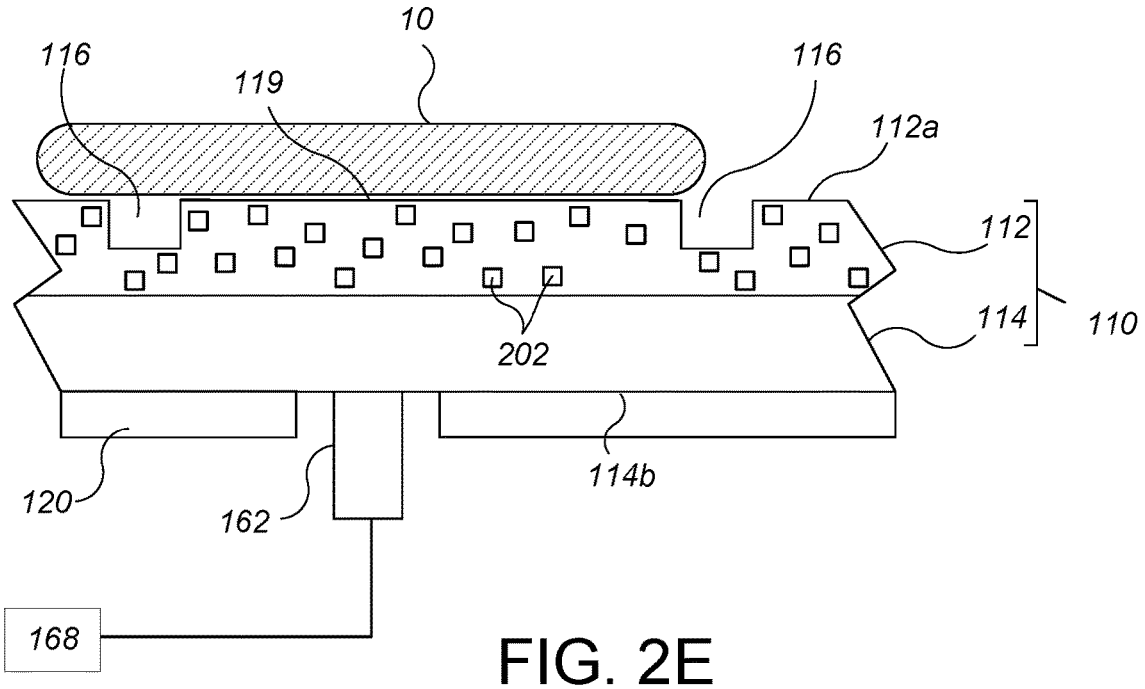
FIG. 2E illustrates a schematic cross-sectional view of another implementation of a polishing pad in contact with an acoustic sensor.
Figure 2F:
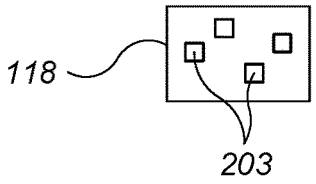
FIG. 2F illustrates a schematic cross-sectional view of an acoustic window having liquid-filled pores.

In the implementations of FIGS. 2A-2D, the acoustic window 118 can be a solid polymer matrix material with liquid-filled pores 203 (see FIG. 2F). The polymer matrix material of the window 118 can be the same composition as the polymer matrix material of the polishing layer 112. The liquid in the pores 203 of the window 118 can be the same composition as the liquid in the pores of the polishing layer 112. However, to provide increased acoustic transmittance, the matrix material of the window 118 can less compressible than the polymer matrix material of the polishing layer 112. In addition, the pores 203 in the window can be smaller or dispersed at a lower density than the pores 202 in the polishing layer 112. In addition, the liquid in the pores 203 in the window can have a different viscosity, e.g., a higher viscosity, than the liquid in the pores 202 in the polishing layer 112.

Where pores 202/203 are present in the polishing layer 112 and/or window 118, the pores can occupy from 1 to 40% by volume of the layer or window. The pores 202/203 can be 10 to 300 μm in width (parallel to the polishing surface) and 2 to 40 μm in depth (perpendicular to the polishing surface); the pores 202/203 can be wider than they are deep. The pores 203 in the window can be narrower and/or shorter and/or occupy a lower percentage of volume than the pores 202 in the polishing layer 112.

The acoustic window 118 can be formed integrally with the surrounding backing layer 114 (and polishing layer 112 if appropriate). In particular, the material of the window 118 and the material of the backing layer 114 can be intermingled at the interface 115. For example, if the window 118 and backing layer 114 are formed by ejection of droplets of different liquid precursor materials, the droplets can intermingle along the boundary before being cured. Similarly, if the window 118 extends through the polishing layer 112, then the window 118 and polishing layer 112 can be formed by ejection of droplets of different liquid precursor materials, and the droplets can intermingle along the boundary before being cured. As such, adhesive is not needed to secure the window 118 to the polishing pad 110.

The acoustic window 118 can be wider than the acoustic sensor 162, e.g., as shown in FIG. 2A, or the two can be of substantially equal width (e.g., within 10%). Where the acoustic window 118 is narrower than the acoustic sensor 162, the sensor can also abut the bottom of the backing layer 114.

The acoustic sensor 162 is a contact acoustic sensor 162 having a surface connected to (e.g., in direct contact with, or having just an adhesive layer) a portion of the backing layer 114 and/or the acoustic window 118. For example, the acoustic sensor 162 can be an electromagnetic acoustic transducer or piezoelectric acoustic transducer. A piezoelectric sensor can include a rigid contact plate, e.g., of stainless steel or the like, which is placed into contact with the body to be monitored, and a piezoelectric assembly, e.g., a piezoelectric layer sandwiched between two electrodes, on the backside of the contact plate.

The acoustic sensor 162 can be secured to a portion of the backing layer 114 and/or to the acoustic window 118 by an adhesive layer. The adhesive layer increases the contact area between the acoustic sensor 162 and the backing layer 114 and/or acoustic window 118, reduces undesirable motion in the acoustic sensor 162 during polishing operations, and can reduce the presence of gas pockets between the acoustic sensor 162 and the backing layer 114 and/or acoustic window 118 thereby improving the coupling to the sensor, thus reducing noise in the acoustic signal received by the acoustic sensor 162. The adhesive layer 170 can be a glue applied between the acoustic sensor 162 and the backing layer 114 and/or acoustic window 118, or an adhesive strip (e.g., tape). For example, the adhesive layer can be a cyanoacrylate, pressure sensitive adhesive, hot melt adhesive, etc. However, in some implementations, the acoustic sensor 162 contacts the acoustic window 118 directly.

The acoustic window 118 extends through the backing layer 114 such that one surface, e.g., an upper surface, contacts a lower surface 112*b* of the polishing layer 112. The opposing surface, e.g., a bottom surface, can be coplanar with a lower surface of the backing layer 114.

The acoustic window 118 can be composed of a non-porous material. In general, non-porous materials transmit acoustic signals with reduced noise and dispersion compared to porous materials. The acoustic window 118 material can have a compressibility within a range of the compressibility of the surrounding matrix material 204 that reduces the effect of the acoustic window 118 on the polishing characteristics of the polishing layer 112. In some implementations, the acoustic window 118 compressibility is within 10% of the matrix material 204 compressibility (e.g., within 8%, within 5%, within 3%). In some implementations, the acoustic window 118 is opaque to light, e.g., visible light. The acoustic window 118 can be composed of one or more of polyurethane, polyacrylate, polyethylene, or another polymer that has a sufficiently low acoustic impedance coefficient.

The acoustic window 118 is shown extending through the total thickness of the backing layer 114. However, the bottom of the acoustic window 118 could be recessed relative to the bottom of the backing layer 114. The acoustic sensor 162 extends through an aperture in the platen 120 to contact the underside of the window 118.

In some implementations, the acoustic monitoring system 160 includes an acoustically transmissive layer, e.g., an index-matching material, between the acoustic sensor 162 and the window 118. Assuming an adhesive is used, the acoustically transmissive layer can be in contact with the adhesive layer which provides increased acoustic signal coupling between the elements in contact with the transmissive layer. The transmissive layer can be arranged between the acoustic window 118 and the adhesive layer, or between the adhesive layer and the acoustic sensor 162. In some implementations, the acoustic monitoring system 160 includes the adhesive layer, the transmissive layer, or both. For example, the transmissive layer can be a layer of Aqualink™, Rexolite, or Aqualene™. In some implementations, the transmissive layer has an acoustic attenuation coefficient that is within 20%, e.g., 10%, of the acoustic attenuation coefficient of the acoustic window 118. The acoustically transmissive layer can have an acoustic attenuation coefficient less than the acoustic attenuation coefficient of the surrounding backing layer 114.

FIG. 2B shows an implementation of the pad 110 having a region 119 in the polishing layer 112 in which the region 119 does not includes pores 202, but can otherwise be constructed as described for the implementation of FIG. 2A. Without wishing to be bound by theory, the acoustic signal dispersion through the region 119 can be reduced by decreasing the number of changes of acoustic refractive index associated with multiple material boundaries, such as for example, the contact area between the matrix material 200 and the pores 202. Therefore the acoustic signal which reaches the acoustic window 118 and acoustic sensor 162 arranged beneath can have decreased dispersion and noise. Thus, in this implementation the window 118 might not include pores.

In some implementations, the acoustic window 118 extends through the thickness of the pad 110. As shown in FIG. 2C, the acoustic window 118 extends through both the polishing layer 112 and the backing layer 114. Here, the acoustic window 118 has a lower acoustic impedance than the surrounding polishing layer 112 and backing layer 114. The acoustic window 118 is positioned such that the top surface of the acoustic window 118 is coplanar with the polishing surface 112*a*, and the bottom surface of the acoustic window is coplanar with the lower surface of the backing layer 114, e.g., lower surface 114*b*, that contacts the platen 120. The acoustic sensor 162 contacts the exposed surface of the acoustic window 118 and receives the transmitted acoustic signal.

The acoustic window 118 is formed of a different material than the polishing layer 112. This permits the backing layer 114 to be composed of a wider range of materials to meet the needs of the CMP operation. In other respects, the implementation of FIG. 2C be constructed as described for the implementations of FIGS. 2A-2B.

FIG. 2D illustrates an implementation that is similar to FIG. 2A or 2B, but the window 118 in the backing layer 114 is provided by a portion of the polishing layer 112 that projects downward into an aperture 114*a* in the backing layer 114. Thus, the window 118 forms a unitary body with the rest of the polishing layer 112, i.e., there is no gap, discontinuity of material composition, etc., that provides a seam between the two portions. The bottom surface of the protruding portion 118 of the polishing layer can be coplanar with the lower surface 114*b* of the backing layer 114.

In addition, although FIG. 2D illustrates the region 119 of the polishing layer 112 as lacking pores (such as in FIG. 2B), the window 118 can include liquid-filled pores 202 (such as those shown in FIG. 2A). Either the upper section that spans the thickness of the polishing layer 112 can include liquid-filled pores 202, or the lower protruding portion can include liquid-filled pores 202, or both.

Referring to FIG. 2E, in some implementations the acoustic transmission of both the polishing layer 112 and the backing layer 114 are sufficiently high that an acoustic window is not required. In this case, the acoustic sensor 162 can be placed in direct contact with the lower surface 114*b* of the backing layer 114.

Conventional polishing pads 110 typically include a porous backing layer 114. Without being limited to any particular theory, the pores 202 increase the acoustic impedance of the backing layer 114. However, by forming the backing layer 114 of a non-porous but compressible material, a significantly lower acoustic impedance can be achieved, thus enabling monitoring of an acoustic signal without requiring a window 118 for the backing layer 114. In addition, as described above, the liquid-filled pores 202 are also acoustically transmissive and thus do not increase acoustic impedance such that a window 118 is needed for the polishing layer 112. Moreover, the window 118 in the backing layer 114 can have liquid-filled pores. be In some implementations, the acoustic monitoring system 160 includes an active acoustic monitoring system. Such implementations include an acoustic signal generator and an acoustic sensor, such as acoustic sensor 162.

The active acoustic generator generates (i.e., emits) acoustic signals from a side of the substrate closer to the polishing pad 110. The generator can be connected by circuitry 168 to a power supply and/or other signal processing electronics 166 through a rotary coupling, e.g., a mercury slip ring. The signal processing electronics 166 can be connected in turn to the controller 190, which can be additionally configured to control the magnitude or frequency of the acoustic energy transmitted by the generator, e.g., by variably increasing or decreasing the current supply to the generator. The acoustic signal generator 163 and acoustic sensor 162 can be coupled to one another, though this is not required. The sensor 162 and the generator can be decoupled and physically separated from one another. For the generator, commercially available acoustic signal generators can be used. The generator can be attached to platen 120.

Figure 3:
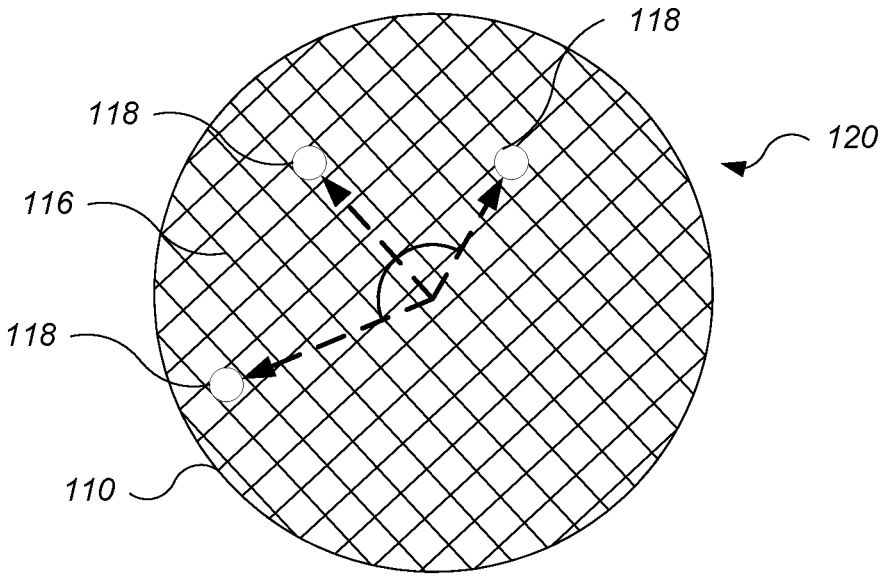
FIG. 3 illustrates a schematic top view of a polishing pad having multiple acoustic windows.

In some implementations a plurality of acoustic sensors 162 can be installed in the platen 120 beneath respective acoustic windows 118. Each acoustic sensor 162 has an associated acoustic window 118. Each sensor 162 can be configured in the manner described for any of FIGS. 1 and 2A-2E. In some implementations, such as the implementation of FIG. 3, the plurality of sensors 162 can be positioned at different angular positions around the axis of rotation of the platen 120, but at the same radial distance from the axis of rotation. In particular, the sensors 162 can be distributed at equal angular intervals around the axis of rotation. In some implementations, the plurality of sensors 162 are positioned at different radial distances from the axis of rotation of the platen 120, but at the same angular position. In some implementations, the plurality of sensors 162 are be positioned at different angular positions around and different radial distances from the axis of rotation of the platen 120, as shown in the implementation of FIG. 3.

Figure 4:
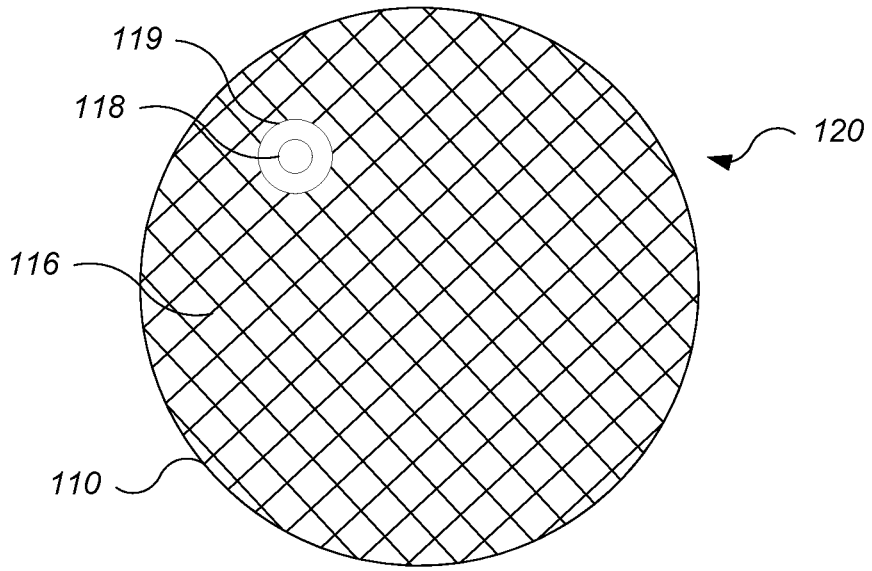
FIG. 4 illustrates a schematic top view of a polishing pad having a solid portion surrounding an acoustic window.

In some implementations, the acoustic window 118 is surrounded by a smooth portion 174 of the polishing layer 112. As shown in FIG. 4, the smooth portion 174 lacks grooves 116 and is coplanar with the upper surface of the acoustic window 118. Implementations including a smooth portion 174 surrounding the acoustic window 118 can reduce noise associated with the substrate 10 interacting with the grooves 116 of a polishing layer 112 during a polishing operation.

Turning now to the signal from the sensor 162 of any of the prior implementations, the signal, e.g., after amplification, preliminary filtering and digitization, can be subject to data processing, e.g., in the controller 190, for either endpoint detection or feedback or feedforward control.

In some implementations, the controller 190 is configured to monitor acoustic loss. For example, the received signal strength is compared to the emitted signal strength to generate a normalized signal, and the normalized can be monitored over time to detect changes. Such changes can indicate a polishing endpoint, e.g., if the signal crosses a threshold value.

In some implementations, a frequency analysis of the signal is performed. For example, frequency domain analysis can be used to determine changes in the relative power of spectral frequencies, and to determine when a film transition has occurred at a particular radius. Information about time of transition by radius can be used to trigger endpoint. As another example, a Fast Fourier Transform (FFT) can be performed on the signal to generate a frequency spectrum. A particular frequency band can be monitored, and if the intensity in the frequency band crosses a threshold value, this can indicate exposure of an underlying layer, which can be used to trigger endpoint. Alternatively, if a location (e.g., wavelength) or bandwidth of a local maxima or minima in a selected frequency range crosses a threshold value, this can indicate exposure of an underlying layer, which can be used to trigger endpoint. For example, for monitoring of polishing of inter-layer dielectric (ILD) in a shallow trench isolation (STI), a frequency range of 225 kHz to 350 kHz can be monitored.

As another example, a wavelet packet transform (WPT) can be performed on the signal to decompose the signal into a low-frequency component and a high frequency component. The decomposition can be iterated if necessary to break the signal into smaller components. The intensity of one of the frequency components can be monitored, and if the intensity in the component crosses a threshold value, this can indicate exposure of an underlying layer, which can be used to trigger endpoint.

Assuming the positions of the sensors 162 relative to the substrate 10 are known, e.g., using a motor encoder signal or an optical interrupter attached to the platen 120, the positions of the acoustic events on the substrate can be calculated, e.g., the radial distance of the event from the center of the substrate can be calculated. Determination of the position of a sensor relative to the substrate is discussed in U.S. Pat. Nos. 6,159,073 and 6,296,548, incorporated by reference.

Various process-meaningful acoustic events include micro-scratches, film transition break through, and film clearing. Various methods can be used to analyze the acoustic emission signal from the waveguide. Fourier transformation and other frequency analysis methods can be used to determine the peak frequencies occurring during polishing. Experimentally determined thresholds and monitoring within defined frequency ranges are used to identify expected and unexpected changes during polishing. Examples of expected changes include the sudden appearance of a peak frequency during transitions in film hardness. Examples of unexpected changes include problems with the consumable set (such as pad glazing or other process-drift-inducing machine health problems).

In operation, as a device substrate 10 is being polished at the polishing station 100, an acoustic signal is collected from the in-situ acoustic monitoring system 160. The signal is monitored to detect exposure of the underlying layer of the substrate 10. For example, a specific frequency range can be monitored, and the intensity can be monitored and compared to an experimentally determined threshold value.

Detection of the polishing endpoint triggers halting of the polishing, although polishing can continue for a predetermined amount of time after endpoint trigger. Alternatively or in addition, the data collected and/or the endpoint detection time can be fed forward to control processing of the substrate in a subsequent processing operation, e.g., polishing at a subsequent station, or can be fed back to control processing of a subsequent substrate at the same polishing station. For example, detection of the polishing endpoint can trigger modification to the current pressures of the polishing head. As another example, detection of the polishing endpoint can trigger modification to the baseline pressures of the subsequent polishing of a new substrate.

Implementations and all of the functional operations described in this specification can be implemented in digital electronic circuitry, or in computer software, firmware, or hardware, including the structural means disclosed in this specification and structural equivalents thereof, or in combinations of them. Implementations described herein can be implemented as one or more non-transitory computer program products, i.e., one or more computer programs tangibly embodied in a machine readable storage device, for execution by, or to control the operation of, data processing apparatus, e.g., a programmable processor, a computer, or multiple processors or computers.

A computer program (also known as a program, software, software application, or code) can be written in any form of programming language, including compiled or interpreted languages, and it can be deployed in any form, including as a standalone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. Processors suitable for the execution of a computer program include, by way of example, both general and special purpose microprocessors, and any one or more processors of any kind of digital computer.

Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

The above described polishing apparatus and methods can be applied in a variety of polishing systems. Either the polishing pad, or the carrier head, or both can move to provide relative motion between the polishing surface and the wafer. For example, the platen may orbit rather than rotate. The polishing pad can be a circular (or some other shape) pad secured to the platen. Some aspects of the endpoint detection system may be applicable to linear polishing systems (e.g., where the polishing pad is a continuous or a reel-to-reel belt that moves linearly). The polishing layer can be a standard (for example, polyurethane with or without fillers) polishing material, a soft material, or a fixed-abrasive material. Terms of relative positioning are used; it should be understood that the polishing surface and wafer can be held in a vertical orientation or some other orientations.

While this specification contains many specifics, these should not be construed as limitations on the scope of what may be claimed, but rather as descriptions of features that may be specific to particular embodiments of particular inventions. In some implementations, the method could be applied to other combinations of overlying and underlying materials, and to signals from other sorts of in-situ monitoring systems, e.g., optical monitoring or eddy current monitoring systems.

What is claimed is:

1. A polishing pad, comprising:

a first layer comprising a polishing layer that is optically opaque to visible light and has a polishing surface; and a second layer comprising a backing layer and an acoustic window, the second layer being disposed below the first layer, wherein the acoustic window comprises a solid material having an acoustic impedance less than that of the backing layer and extending through the backing layer to contact a bottom surface of the polishing layer, wherein the polishing layer covers an entirety of the acoustic window, and wherein an entirety of the polishing layer comprises a uniform composition of material extending above both the backing layer and the acoustic window.

2. The polishing pad of claim 1, where the acoustic window is non-porous.

3. The polishing pad of claim 1, where the acoustic window comprises a matrix material with liquid filled pores.

4. The polishing pad of claim 1, wherein the polishing layer has a polishing surface with a first region without grooves and a second region that surrounds the first region that has a plurality of grooves, and wherein the acoustic window is aligned with the first region.

5. The polishing pad of claim 1, wherein the polishing pad comprises a matrix material with pores.

6. The polishing pad of claim 5, wherein a portion of the polishing pad directly above the acoustic window comprises liquid filled pores.

7. The polishing pad of claim 1, wherein the polishing layer has liquid filled pores across the polishing pad.

8. The polishing pad of claim 1, wherein the acoustic window has the same compressibility as the backing layer.

9. The polishing pad of claim 1, wherein the acoustic window and the backing layer are secured by an interface of intermingled polymer.

10. The polishing pad of claim 1, where the backing layer is non-porous.

11. The polishing pad of claim 1, wherein a bottom of the acoustic window is coplanar with a bottom of the backing layer.

12. The polishing pad of claim 1, wherein a top of the acoustic window is coplanar with a top of the backing layer.

13. The polishing pad of claim 1, further comprising a sensor contacting a bottom surface of the acoustic window, wherein an acoustic refractive index of the acoustic window is between that of a portion of the polishing layer above the acoustic window and that of the sensor.

14. The polishing pad of claim 13, wherein the acoustic refractive index of the acoustic window is equal to that of the portion of the polishing layer above the acoustic window.

* * * * *